US006588157B1

(12) United States Patent
Davies

(10) Patent No.: US 6,588,157 B1
(45) Date of Patent: Jul. 8, 2003

(54) BUILDING STRUCTURE

(75) Inventor: Brian T. Davies, Esperance (AU)

(73) Assignee: Brian Investments Pty Ltd, Experance (AU)

( * ) Notice: Subject to any disclaimer, the term of this patent is extended or adjusted under 35 U.S.C. 154(b) by 15 days.

(21) Appl. No.: 09/637,931

(22) Filed: Aug. 14, 2000

(30) Foreign Application Priority Data

Jun. 26, 2000 (AU) ..... 42684/00

(51) Int. Cl.[7] ..... E04B 1/32
(52) U.S. Cl. ..... 52/81.1; 52/81.4; 52/DIG. 10
(58) Field of Search ..... 52/81.1, 81.4, 52/80.1, DIG. 10, 80.2, 80.3

(56) References Cited

U.S. PATENT DOCUMENTS

| | | | | | |
|---|---|---|---|---|---|
| 2,944,370 | A | * | 7/1960 | Malarkey | 52/80.1 |
| 3,646,718 | A | * | 3/1972 | McKenna | 52/79 |
| 3,881,284 | A | * | 5/1975 | Martin | 52/81 |
| 3,921,555 | A | * | 11/1975 | Suzuki et al. | 52/81.1 |
| 4,180,950 | A | | 1/1980 | Foster | |
| 4,285,174 | A | | 8/1981 | Knight | |
| 4,287,690 | A | * | 9/1981 | Berger et al. | 52/81.1 |
| 4,306,392 | A | * | 12/1981 | SoRelle | 52/81 |
| 4,680,901 | A | | 7/1987 | Armitage | |
| 4,686,801 | A | | 8/1987 | Eriksson et al. | |
| 5,170,599 | A | | 12/1992 | Knight | |
| 5,394,661 | A | * | 3/1995 | Noble | 52/167.34 |
| 5,452,555 | A | * | 9/1995 | Lee | 52/584.1 |
| 5,505,025 | A | * | 4/1996 | Fleishman | 52/81.1 |
| 5,628,154 | A | * | 5/1997 | Gavette | 52/81.4 |
| 5,732,518 | A | * | 3/1998 | Roberts | 52/245 |
| 6,134,849 | A | * | 10/2000 | Holler | 52/80.1 |
| 9,216,410 | | * | 4/2001 | Haberman | 52/591.1 |
| 6,295,785 | B1 | * | 10/2001 | Herrmann | 52/745.08 |

FOREIGN PATENT DOCUMENTS

| | | | | |
|---|---|---|---|---|
| AU | 65811/69 | | 7/1971 | |
| AU | 3966/72 | | 9/1973 | |
| AU | 53797/90 | | 10/1990 | |
| AU | 2000027615 | | 10/2000 | |
| FR | 2307217 | | 5/1976 | |
| JP | 406093688 | A * | 4/1994 | 52/81.1 |
| WO | WO 02/01024 | | 1/2002 | |

* cited by examiner

*Primary Examiner*—Carl D. Friedman
*Assistant Examiner*—Jennifer I. Thissell

(57) ABSTRACT

A building structure having a plurality of wall elements connecting together to form a wall is disclosed. The wall elements have a plurality of sides, each side is connected to an adjacent side of a wall element by an interlocking connection means. Methods of building a structure with the wall elements are also disclosed.

26 Claims, 7 Drawing Sheets

BUILDING STRUCTURE

The present invention relates to a building structure and a method of forming a building structure. In particular, although not exclusively, the present invention relates to a storage structure.

Typically, buildings are constructed with walls of bricks and/or other building material. A roof is then built on top of the wall. The roof is made of different building materials again. Having many types of building material presents difficulties due to the variety of construction techniques that must be employed and the associated expense. Where the building is to be air-tight, all the joins must be sealed.

When the building is used for grain storage, the shape of the structure needs to account for the manner in which grain lies on the ground. Due to the particulate nature of grain, it prefers a structure having a round base and, depending on the type of grain, a rill angle of about 30°. Dome shaped structures are ideal for storing grain as they have an internal shape to accommodate the grain, as well as an external shape which provides a wind resistant profile. Unfortunately dome shaped structures are difficult to build using traditional building materials and construction techniques.

An object of the present invention is to overcome at least some of the above problems by providing a building structure that can be more easily constructed, and is suited to dome shaped structures.

In accordance with a first aspect of the present invention, there is provided a building structure having a wall comprising a plurality of wall elements, each wall element connected to a plurality of other wall elements so as to form the wall, wherein each wall element includes a connecting means for connecting the adjacent wall elements together to form the wall.

Preferably, each wall element includes a first face and a second face opposite the first face. More preferably, each wall element further includes a plurality of sides. Preferably, the connecting means of each wall element includes an interlocking portion located on each side of the wall element for connecting each said side to another side of another wall element.

Preferably, the wall is curved to form a curved part of the structure. More preferably, the wall is curved to form a dome shaped structure.

Preferably, the first face of each wall element is of concave shape. More preferably, the first face of each wall element, in use, collectively forms an interior face of the wall. Preferably, the second face of each wall element is convex in shape. More preferably, the second face of each wall element, in use, collectively forms an exterior face of the wall.

Preferably, the wall is formed of at least three consecutively connected rings of interlocking wall elements, each of the wall elements in each ring being of the same size, each of the wall elements in a first ring of the consecutively connected rings being larger than the wall elements of a second ring of the consecutively connected rings and each of the elements in the second ring being larger then the wall elements of a third ring of the consecutively connected rings.

Preferably, each wall element is in the form of a tile. More preferably, the shape of the first face and the second face of the wall elements is a polygon in plain view.

In one embodiment, the shape of the first face and second face of the wall elements is a regular polygon in plan view. Still more preferably, when the wall elements are connected together they tessellate to form the wall. Preferably, the wall is formed of one or more types of wall element, each type of wall element having a different shape of regular polygon in plan view. Preferably, one of the types of regular polygon is a hexagon. Preferably, another of the types of regular polygon is a pentagon. Preferably, all wall elements of each type are uniform in size and shape.

In another embodiment, the wall element is an irregularly shape hexagon.

Preferably, all wall elements of each ring are uniform in size and shape.

Preferably, the interlocking portions that connect two wall elements together are a complementary projection and recess, one of each formed on each of the sides connected together. Where the polygon is a hexagon, three of the sides have the projection and the other three sides have the recess.

Typically, the wall consists of wall elements only or wall elements and an adhesive only.

In accordance with a second aspect of the present invention, there is provided a method of constructing a building structure comprising the steps of:

constructing a wall made of wall elements by placing each wall element adjacent a plurality of other wall elements; and, connecting a connection means of each wall element to a corresponding connection means of each adjacent wall element.

Preferably, adjacent wall elements are connected by placing them with abutting sides together of each of the adjacent wall elements, and connecting an interlocking portion of the connecting means located on each side of each of the adjacent wall elements. Preferably, the wall elements are placed in an arrangement where an inside face of each wall element forms a part of an inside surface of the wall. More preferably, the wall elements are placed in an arrangement where an outside face of each wall element forms a part of an outside surface of the wall.

Preferably, the wall elements are placed in an arrangement where a curve in the body of each wall element contributes to a curve in the wall. More preferably, the wall elements are placed so that a concave curve of the inside face of each wall element contributes to form a constant concave curve in the inside surface of the wall. Still more preferably, the wall elements are placed so that a convex curve of the outside face of each wall element contributes to form a constant convex curve in the outside surface of the wall.

Preferably, constructing the curved wall includes the steps of:

connecting a plurality of wall elements having a first size together to form a first ring, connecting a plurality of wall elements having a second size, smaller than the first size, together to form a second ring interlocking with the first ring, connecting a plurality of wall elements having a third size, smaller than the second size, together to form a third ring interlocking with the second ring.

Preferably, the wall elements are placed so as to form a circular wall. More preferably, the wall elements are placed so as to form a dome shaped wall.

Preferably, two wall elements are coupled together by an interlocking means of the wall element. More preferably, an adhesive is used to permanently couple the wall elements together.

Preferably, a couple between the wall elements is sealed by the adhesive acting as a sealant. Preferably, each wall element is placed by a positioning arm.

Preferably, each wall element is drawn over an external surface of the partly constructed wall, with the partly constructed wall bearing some of the weight of the wall element as it is moved into position to be placed in the wall.

In accordance with the third aspect of the present invention, there is provided an apparatus for constructing a building comprising: a positioning arm having a pivotal end and a distal end for releasably holding a building element; and an anchor means for anchoring the positioning arm to a particular point on the ground, wherein the pivotal end is pivotally connected to the anchor means, whereby in use, the positioning arm is arranged to hold the building element, the positioning arm is pivoted to position the building element at a desired place so that the building element may be used to form part of the building, and the positioning arm releases the building element.

Preferably, the apparatus includes a lifting means for moving a building element into position where the positioning arm can take hold of the building element.

Preferably, the positioning arm is variable in length to assist in either taking hold of the building element or positioning the building element. More preferably, the positioning arm includes a means of returning the arm to a predetermined length in order to provide a constant radius to a curve of a wall of building elements.

In accordance with the fourth aspect of the present invention, there is provided a method of constructing a building comprising the steps of: coupling a pivotal end of a positioning arm to the centre of where the building is to be constructed, releasably coupling a building element to a distal end of the positioning arm; pivoting the positioning arm to move the building element into a position where the building element is used to form part of the building; connecting the building element to another building element; and releasing the building element from the positioning arm.

Preferably, the method further includes a step of using the positioning arm as a compass to mark the position of a curved wall to be constructed as part of the building. More preferably, the method further includes using the positioning arm to position each building element at a predetermined radius from the centre of where the building is to be constructed.

In accordance with a fifth aspect of the present invention there is provided a wall element for use in constructing a wall of a building structure, said wall element comprising a connection means for connecting the wall element to other wall elements to form the wall.

In order to provide a better understanding of the present invention, an embodiment will now be described with reference to the accompanying drawings, in which.

Figure 1:
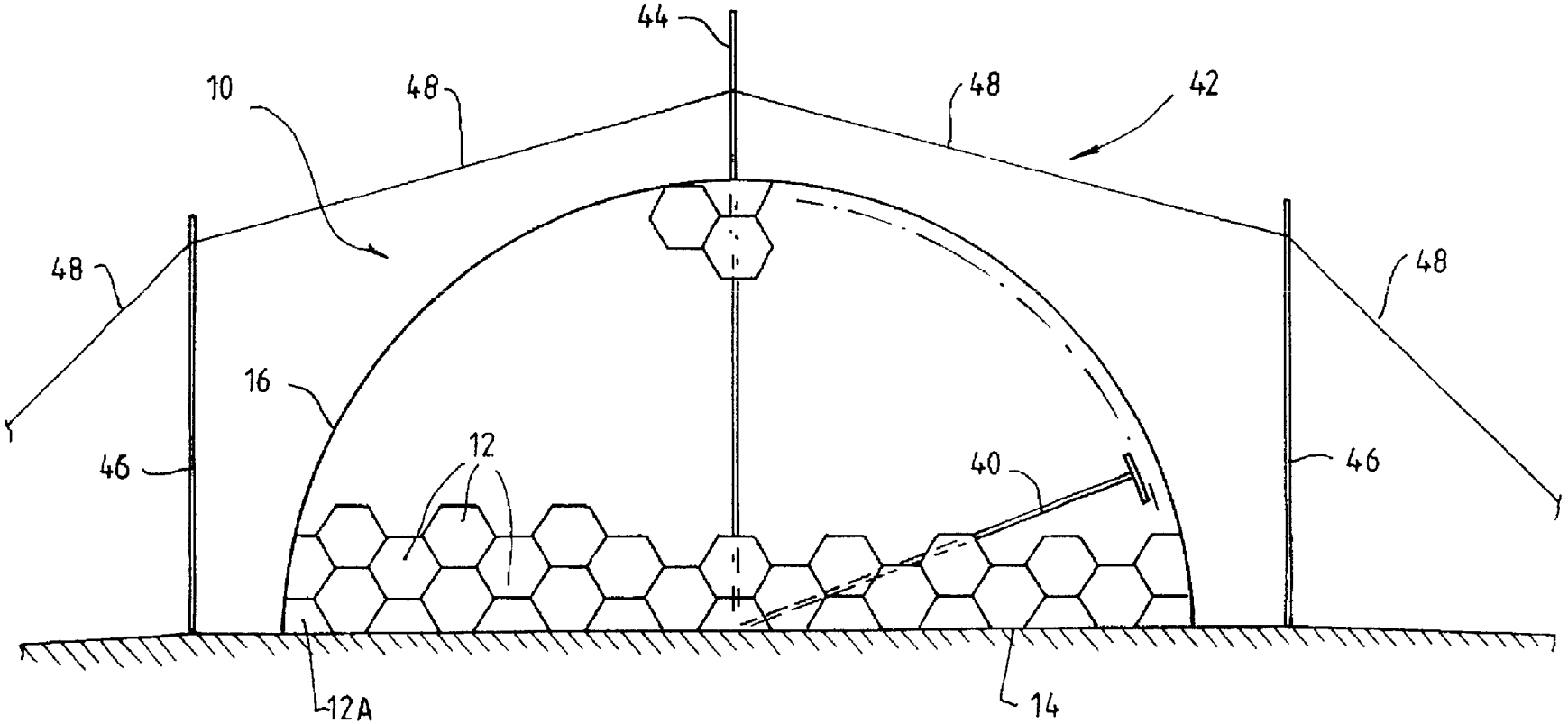
FIG. 1 is a side view of a schematic representation of an embodiment of a building being constructed in accordance with the present invention.

Referring to FIG. 1, there is shown a first embodiment of a building structure 10 which includes a wall 16 comprising a plurality of wall elements 12. The wall elements are connected together to form the wall 16. Preferably, there is a combination of types of wall elements used to construct the wall 16. The wall elements of each type of wall elements are uniform in size and shape. They are also connected together to form a tessellation. The wall 16 is of a dome shape and rests on a foundation 14 to form the building structure 10.

Figure 2:
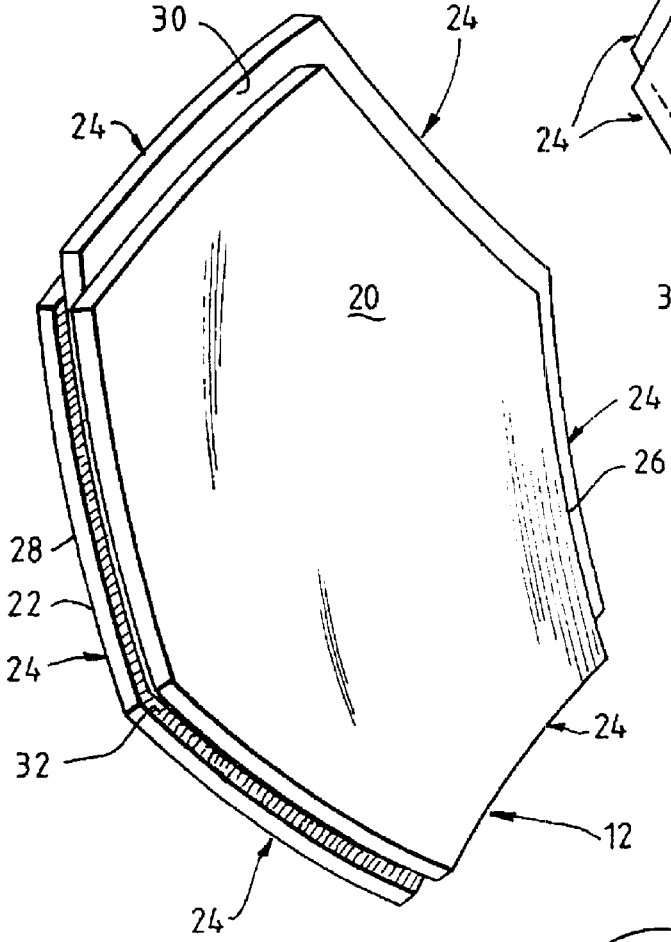
FIG. 2 is a perspective view of a wall element used to construct a building in accordance with the present invention.
Figure 3:
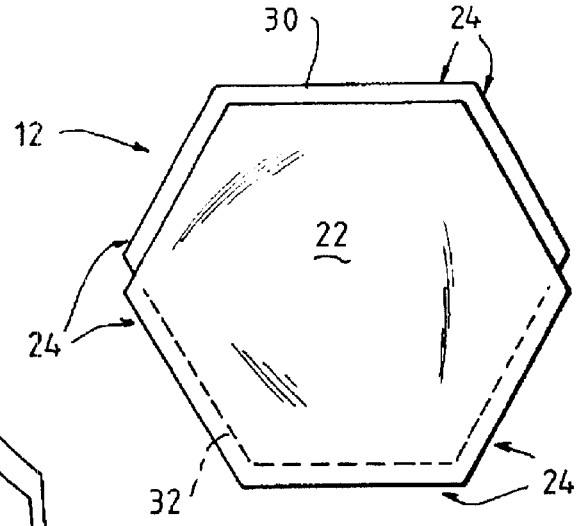
FIG. 3 is a plan view of the wall element of FIG. 2.

Referring to FIG. 2, there is shown a wall element 12 in the form of a tile. The wall element 12 includes an inside face 20 and an opposed outside face 22. The wall element 12 also includes a plurality of sides 24. In this case, the wall element is hexagonal in plan view, therefore there are six sides 24. Another type of wall element is a pentagon in plan view (not shown). The body of the wall element is curved. More specifically, the wall element 12 is shaped with a concave curve as indicated by 26 on the inside face 20. The wall element 12 is also shaped with a convex curve as indicated by 28 on the outside face 22. The curvature of the body, and the inside and outside faces is such that when the wall elements 12 are coupled together to form the wall 16 the wall is curved so as to form a hollow hemisphere. That is, the radius of curvature of the inside face 20 is the inside radius of the hemisphere and the radius of the curvature of the outside face 22 is the outside radius of the hemisphere.

Each wall element 12 is connected to another wall element by abutting sides of adjacent wall elements and interlocking a complementary projection 30 and recess 32 between the adjacent wall elements. One side of one of the abutted wall elements has the projection 30 and the other has the recess 32. In this case, three of the sides 24 have the projection 30 and three of the sides 24 have the recess 32. There are three projections 30 on three adjacent sides and three recesses 32 on the other three adjacent sides. In this embodiment each projection 30 is in the form of a tongue and each recess 32 is in the form of a groove adapted to receive the tongue in close-fitting relation.

Referring to FIGS. 5 to 9, an alternative embodiment is shown as building structure 10, which also includes a wall 16 comprising a plurality of wall elements 12 connected together. The wall elements 12 are arranged in rings 15. The wall elements 12 in each ring 15 are of the same size and shape. The rings 15 are of decreasing radius (size) and sit one on top of the other in an interlocking manner. The wall elements 12 of each consecutive ring are smaller than the wall elements of the previous ring.

Figure 6:
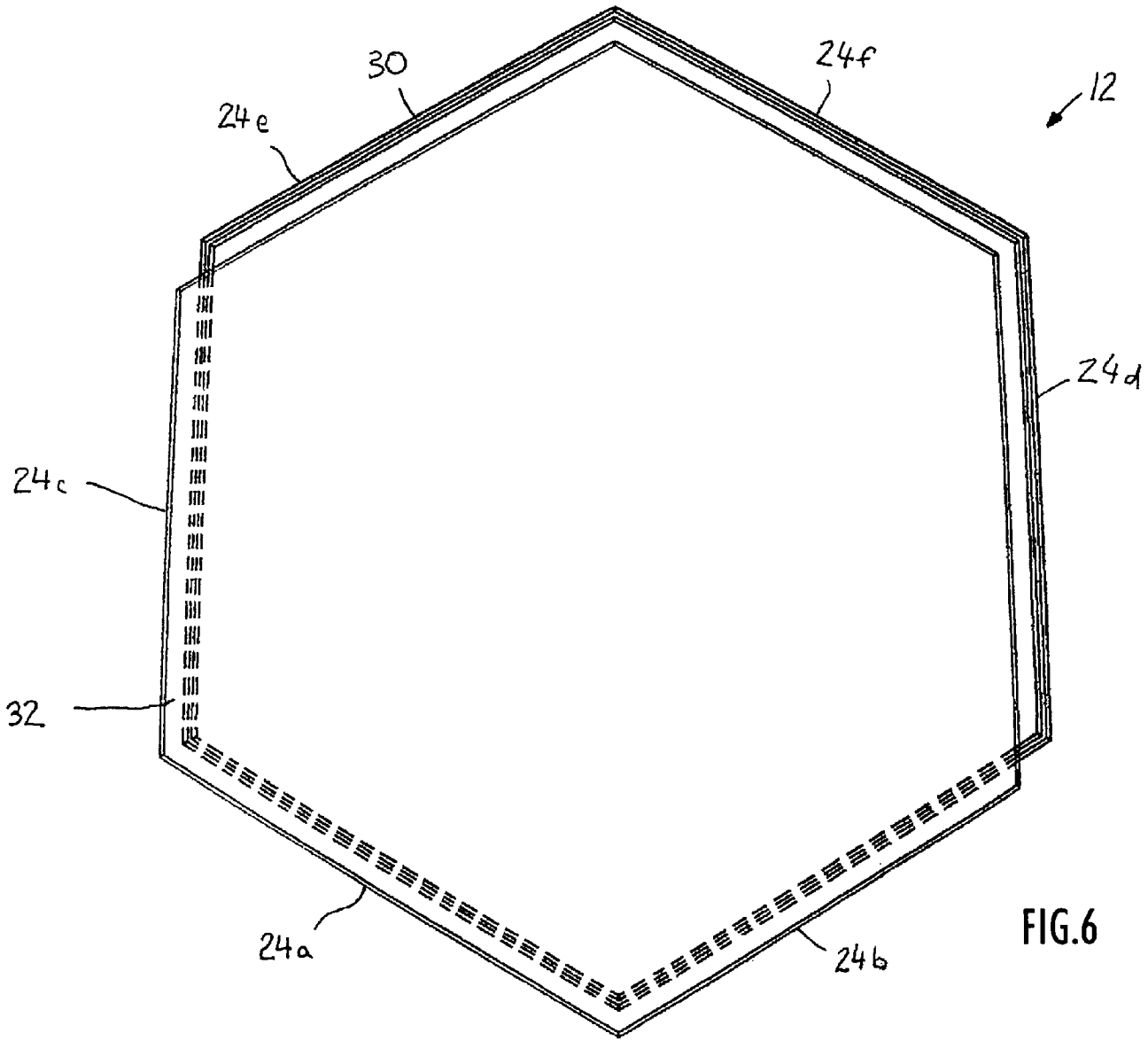
FIG. 6 is a plan view of a wall element used to construct a building in accordance with the present invention.
Figure 7:
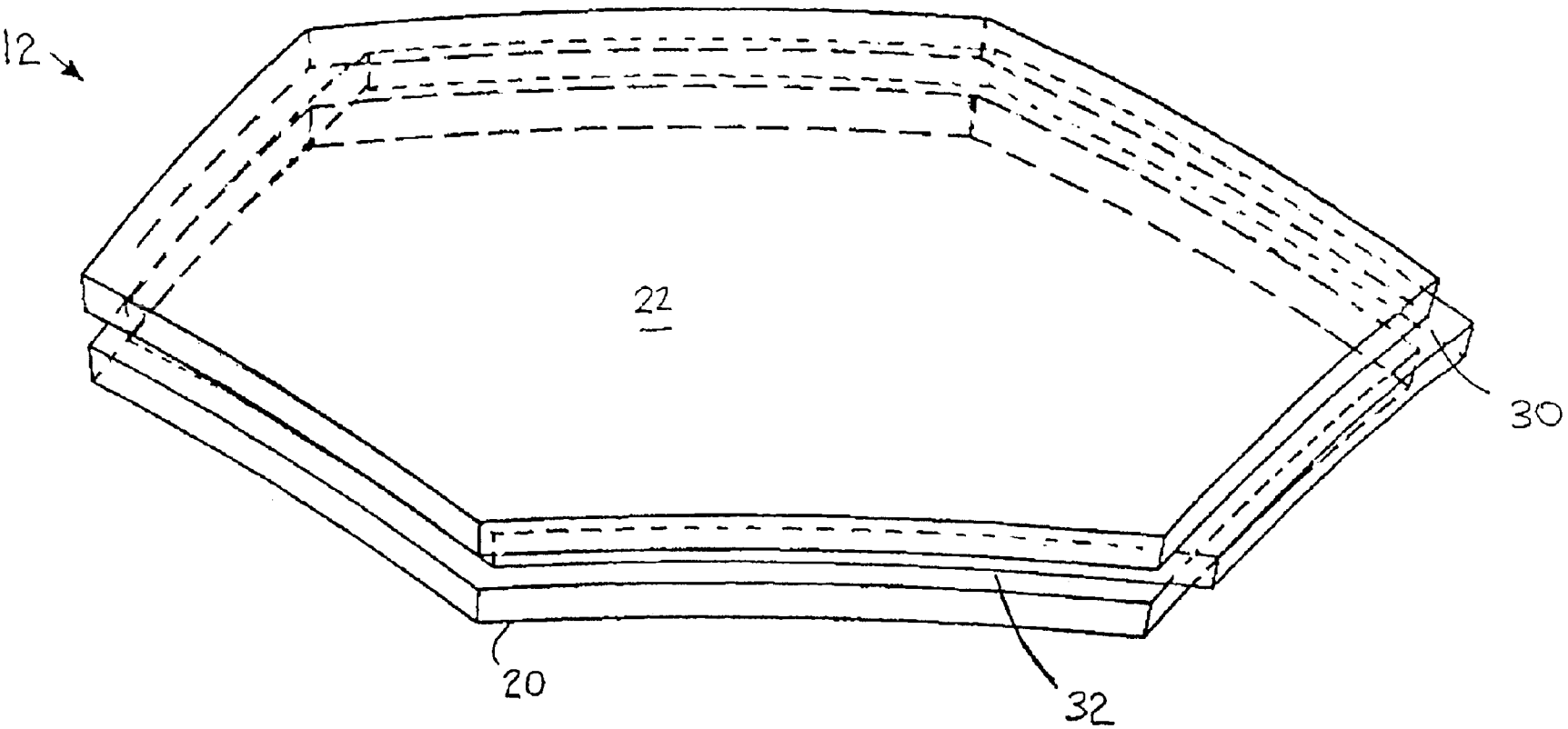
FIG. 7 is a perspective view of a wall element of FIG. 6.
Figure 8:
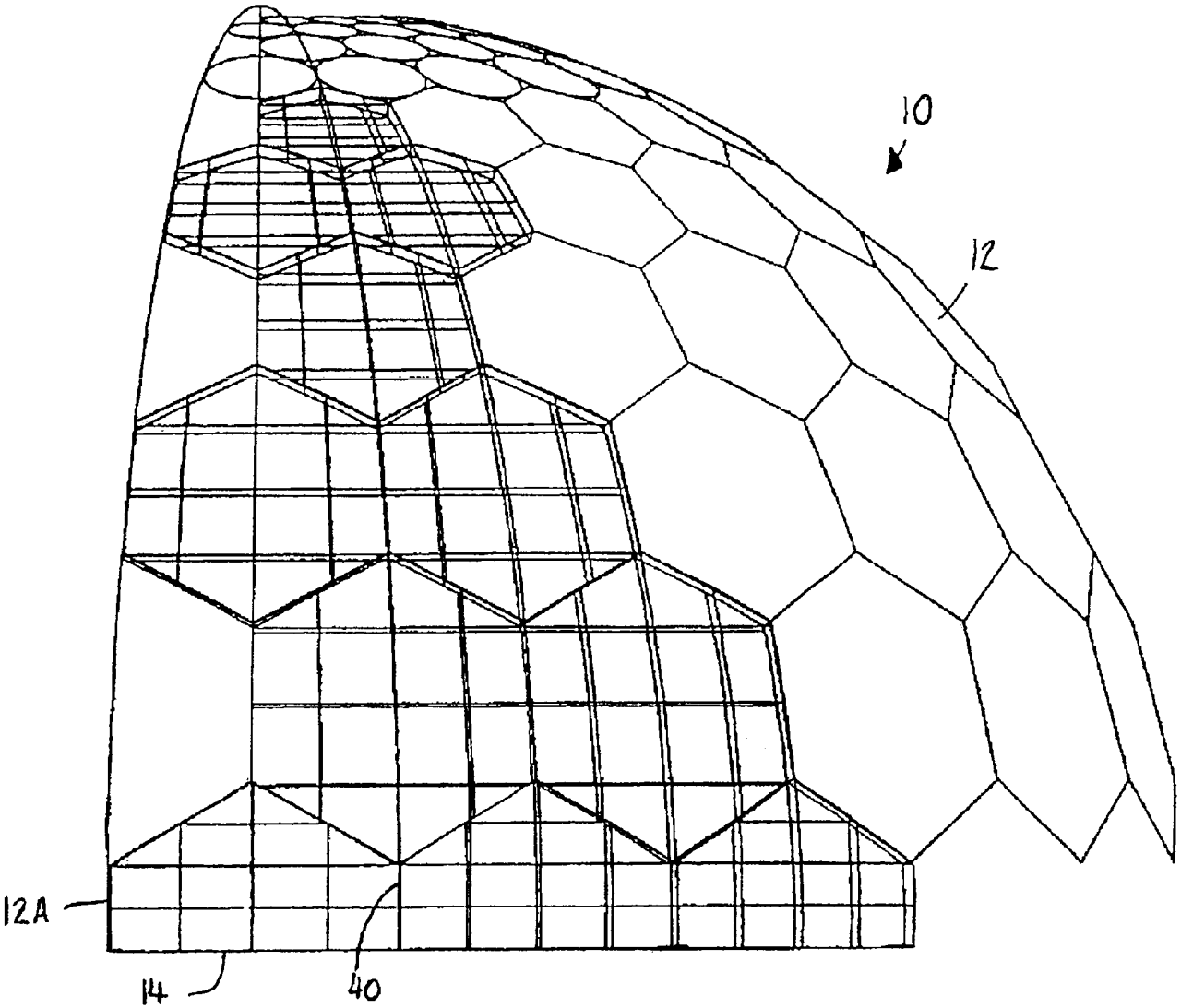
FIG. 8 is a perspective view of a section of a wall if the building of FIG. 5; and, FIG. 9 is a perspective view of an example of a section of a wall showing the irregular nature of the wall elements in each ring of wall elements.

As shown in FIGS. 6 and 7, each wall element 12 roughly hexagonal in plan view, out is not a true hexagons though as the length of the sides are not the same size. Sides 24*a* and 24*b* are the same length, 24*c* and 24*d* are the same length and 24*e* and 24*f* are the same length. However sides 24*a* and 24*b* are longer than sides 24*c* and 24*d*, which are longer than sides 24*e* and 24*f*. It can also be seen that opposite sides (for example 24*c* and 24*d*) are not parallel.

The wall elements may be constructed of high density foam, aerated concrete, plastic epoxy resin, foamed plastic or any other suitable building material. The wall elements may even be injection moulded on site to reduce transport costs.

An adhesive may be used between the projections and recess of each wall member to permanently connect the wall elements together. The adhesive may also act as a sealant so that the join between each wall member is air tight.

The interconnection between each wall element may be reinforced by using pins secured through each projection and recess when they interlock together. The pins increased tensile strength across the interlock and provide improved internal loading. Internal reinforcing may be required within each wall element to withstand load stress of the pins on the wall element.

A construction apparatus maybe used to construct the building structure 10. The apparatus includes a positioning arm 40 and a lifting rig 42. The positioning arm 40 is pivotally attached to the ground at the centre of the location at which the building structure is to be constructed. The positioning arm 40 has a distal end which is able to releasably hold a building element, such as a wall element 12. The positioning arm 40 maybe used as a compass to mark the ground with the circumference of the dome shaped building structure 10. A foundation 14 may be poured in the correct position as indicated by the mark left by the positioning arm 40. The positioning arm 40 may then be used to hold a wall element 12 and move it into position so that it is at the correct radius from the centre of the dome. Once the wall element 12 is in the correct position, and is connected in place the positioning arm may then release the wall element and be pivoted away in order to take hold of and lift another wall element to repeat this process. The building may be constructed by repeatedly positioning wall elements in their correct position. Layers of wall elements may be formed by placing wall elements in concentric rings one on top of the other. In particular, layers of the same type of wall element are used. Since the positioning arm is within the wall being constructed, it may be necessary to lift wall elements over the partly constructed wall so that they may be held by the positioning arm.

The wall element may be lifted up to the distal end of the positioning arm from the inside or the outside of the wall being constructed. The positioning arm may be telescopically extendable in order to reach past the edge of the wall in order to take hold of another wall element 12. Alternatively, the positioning arm may be telescopically reducible in order to reach within the partly constructed wall to take hold of another wall element from a pile of wall elements with the partly constructed building.

The lifting rig 42 can be used to lift wall elements over the partly constructed wall. The lifting rig 42 may be constructed around where the building structure is to be built. The lifting rig 42 includes a centre post 44 and a plurality of support posts 46 arranged around the building structure. Tie members 48 may be used to interconnect the top ends of the posts 44 and 46. The tie members 48 may be, for example, wire or rope. The lifting rig 42 may be used to lift the wall element up around the exterior of the partly constructed wall. The positioning arm 40 can then take hold of the wall element so that the lifting rig 42 can release the wall element and pick up another while the positioning arm 40 positions the held wall element.

In addition to using the lifting rig 42, the partly constructed wall can be used to bear part of the weight of each wall element as it is lifted. A friction reducing mat can be used to slide the wall element over the external surface of the partly constructed wall.

The first layer of wall elements placed on the foundation 14 may alternate between half elements 12A and complete wall elements 12. This allows the base edge of the wall to be flat and secured on the foundation 14.

Figure 5:
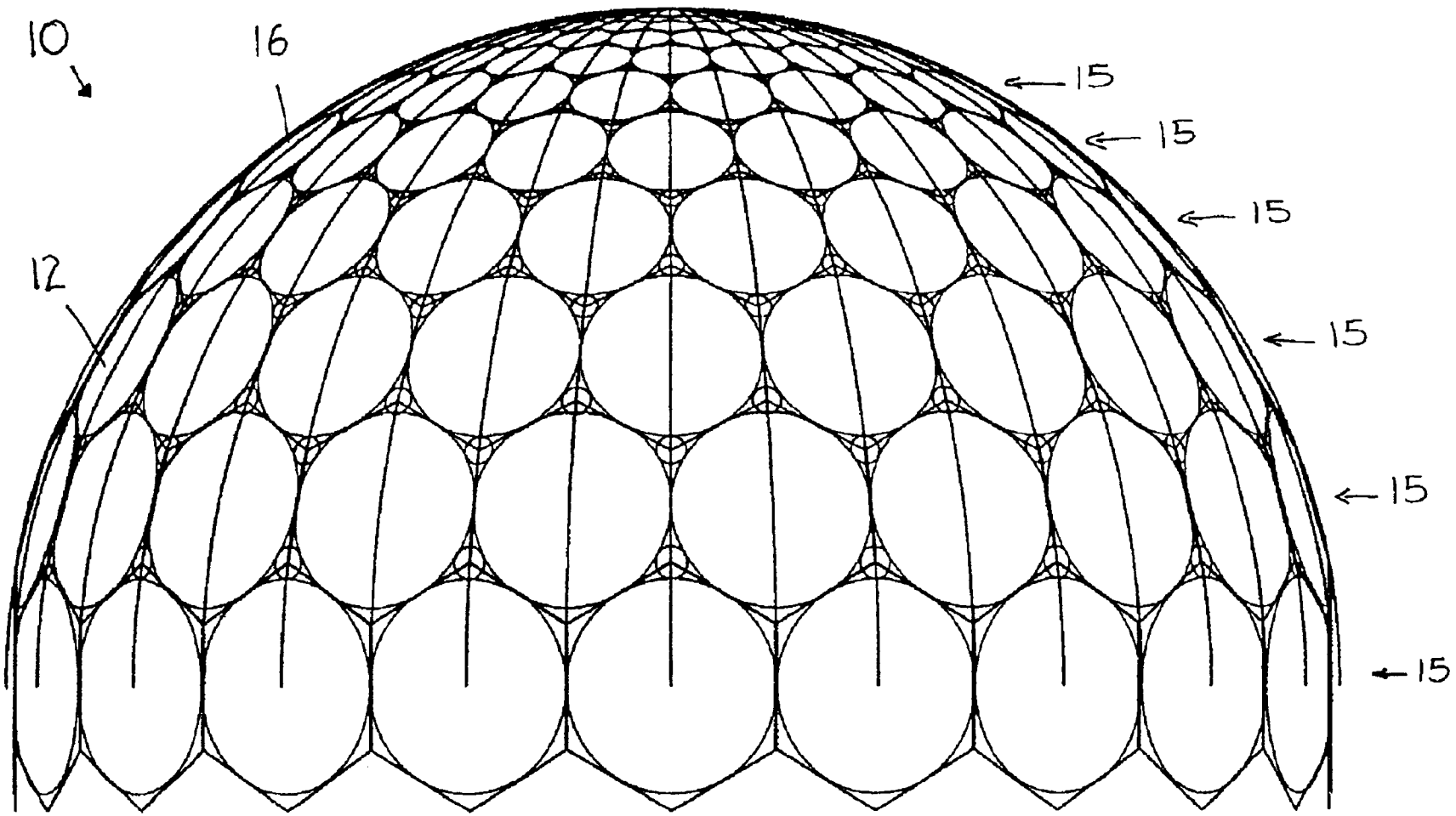
FIG. 5 is a side view of a schematic representation of an embodiment of a building constructed in accordance with the present invention.

The building structure 10 of FIG. 5 may be constructed by positioning wall elements in their correct position in each ring 15. There may be, for example, 20 wall elements in each ring. It is preferred that the number of wall elements evenly divides into 360. Layers of wall elements may be formed by placing wall elements in concentric rings. Each ring is formed one on top of the other. In particular, layers rings of the same size of wall element are used. When the layer is completed the next is commenced, with smaller wall elements needed to create the next layer in another ring of smaller radius. Each ring will have the same numbers of elements as the previous ring. Typically there are about 10 rings.

The process is repeated until a single top element can be positioned in the remaining hole. The top element will have a number of sides equal to twice the number of element in each ring.

The first layer of wall elements placed on the foundation 14 may alternate between half elements 12A and complete wall elements 12. This allows the base edge of the wall to be flat and secured on the foundation 14.

Each wall element in the first ring may be, for example, 2 to 3 meters in height. The actual size of the wall elements will vary depending on the desired radius and size of the building structure to be constructed.

Figure 9:
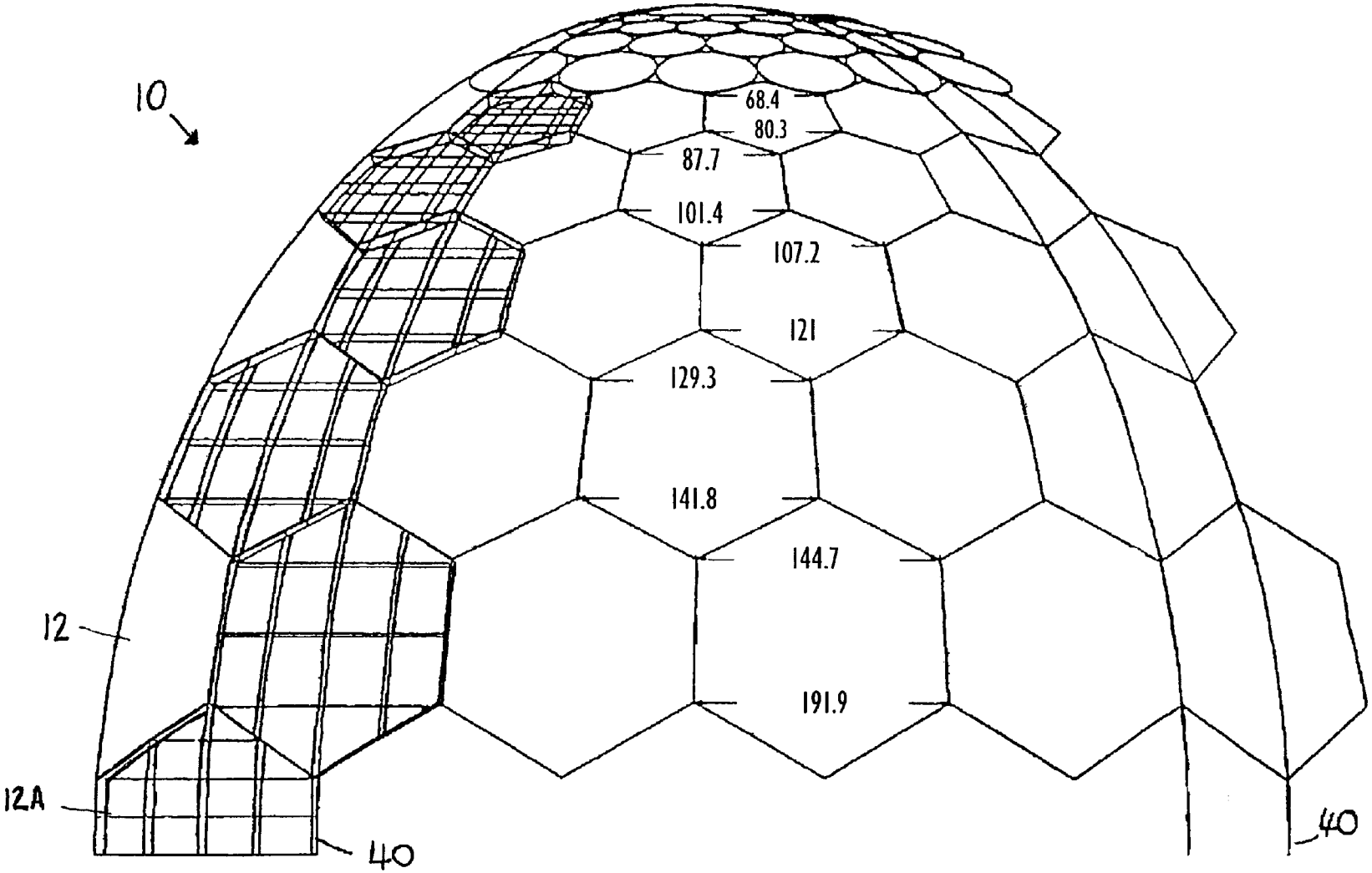

Because of the curve (shown as lines 40) the included angle between each side of the wall elements is not 60° as in the case in an ordinary hexagon. This problem is solved by reducing the size of the tile in each ring (as described above) and by adjusting the shape of the tile. FIGS. 6 and 9 show the tile narrowing towards the top just as the lines 40 narrow the closer to the top of the structure you go. Example measurements are shown in FIG. 9, which represent the relative size relationship between tiles of each ring.

Figure 4:
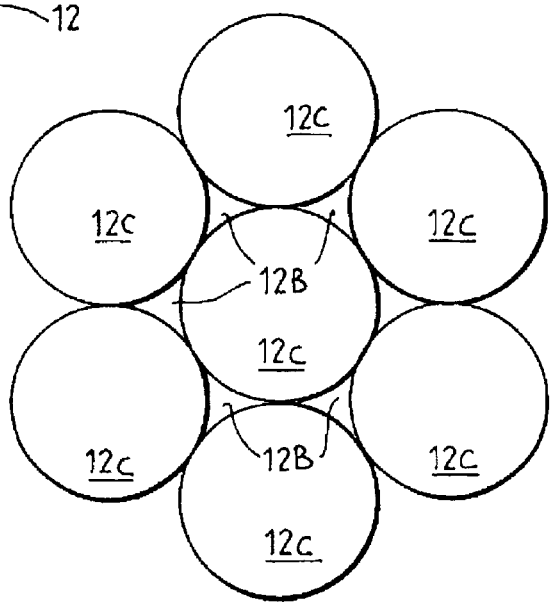
FIG. 4 is a plan view of an alternative embodiment of a wall element in accordance with the present invention.

FIG. 4 shows an alternative to the hexagonal wall element. Here the wall elements 12C are circular in plan view. Each circular wall element 12C fits against six other circular wall elements 12C. In the gaps between the circles are wall elements 12B. These are triangular in plan view with concave sides. In this alternative, the triangles may include projections on each side and the circles may include grooves around its circumference which together form the complementary projection and recess between adjacent wall elements.

It is believed the curve of the wall elements may create problems in fitting many wall elements together. The curve introduces an error in the included angle between each side of the wall elements. To overcome this error, a combination of different types of wall elements are used. The order of placement and relative location of the types of wall elements need to be calculated before construction can begin.

A key wall element is used at the top of the structure and the other elements are placed in layers around the key until the dome structure is formed.

The key may be a regular polygon with a number of sides being a multiple of 6, such as 6, 12 or 26 sizes. A layer of pentagons circles the key and then a ring of hexagons. This continues with repeated layers of key wall element, pentagons and hexagons until the structure is formed. Thus the number and placement of each type of wall element in each layer is calculated.

However, since the structure is normally built from the ground up, the structure is built in reverse to the above calculated order, that is, hexagons with pentagons on top and key wall elements on top again, with this repeating until the structure is completed by the placement of the final key element.

If the wall elements are formed of a transparent material, the shape of each tile may act as a lens with the focal point of the wall of the wall elements being substantially at the centre of the dome. This can provide a concentration of radiant energy and may have application where there is a need to focus solar energy.

It will be clear to those skilled in the art that the present invention has at least the following advantages:

(i) The building structure may be of a dome shape which is well suited to storing, for example, grain and is also well suited to resist wind loading;

(ii) The building structure may be constructed relatively quickly and easily and will thus provide cost efficiencies.

Modifications and variations can be made to the present invention without departing from the basic inventive concepts, such as:

(i) The projections and recesses of each wall element may alternate from one side to the next side rather than three projections in a row and three recess in a row; and, (ii) The wall elements may be of a different shape than a hexagon, such as a triangle, a square, a rectangle, a combination of octagons and squares.

All such modifications are intended to be considered within the scope of the present invention the nature of which is to be determined from the foregoing description and appended claims.

What is claimed is:

1. A building structure comprising a wall including a plurality of wall elements, each wall element having a hexagonal shape and connecting to a plurality of other wall elements so as to form the wall, wherein each wall element includes a connecting means for connecting adjacent wall elements together to form the wall, first and second adjacent sides that are each of the same length, third and fourth opposing sides that are each of the same length and shorter than each of the first and second adjacent sides, and fifth and sixth adjacent sides that are each of the same length and shorter than each of the third and fourth opposing sides, and wherein the wall elements are tessellated to form a dome-shaped structure.

2. A building structure according to claim 1, wherein the connecting means of each wall element includes an interlocking portion located on each side of the respective wall element for connecting each side of the respective wall element to a corresponding side of another wall element.

3. A building structure according to claim 1, wherein each wall element includes a first face and a second face opposite the first face, the first face of each wall element is of concave shape.

4. A building structure according to claim 3, wherein the first face of each wall element, in use, collectively forms an interior face of the wall.

5. A building structure according to claim 3, wherein the second face of each wall element is convex in shape.

6. A building structure according to claim 5, wherein the second face of each wall element, in use, collectively forms an exterior face of the wall.

7. A building structure according to claim 1, wherein the wall is formed by at least three consecutively connected rings of interlocking wall elements, each of the wall elements in each ring being of the same size, each of the wall elements in a first ring of the consecutively connected rings being larger than the wall elements of a second ring of the consecutively connected rings and each of the wall elements in the second ring being larger than the wall elements of a third ring of the consecutively connected rings.

8. A building structure according to claim 2, wherein the interlocking portions connecting two wall elements together include a complementary projection and a recess, and the projection is formed on a connecting side of one of the two wall elements while the recess is formed on a corresponding connecting side of the other of the two wall elements.

9. A method of constructing a building structure including the steps of:

constructing a wall made of wall elements by placing each wall element adjacent a plurality of other wall elements and fastening a connecting means of each wall element to a corresponding connecting means of each adjacent wall element, wherein each wall element has a hexagonal shape and includes first and second adjacent sides that are each of the same length, third and fourth opposing sides that are each of the same length and shorter than each of the first and second adjacent sides, and fifth and sixth adjacent sides that are each of the same length and shorter than each of the third and fourth opposing sides; and tessellating the wall elements to form a dome-shaped structure.

10. A method according to claim 9, wherein adjacent wall elements are connected by placing the adjacent wall elements together so that the sides of each of the adjacent wall elements are abutting the sides of other adjacent wall elements, and connecting an interlocking portion of the connecting means located on each side of each adjacent wall element with a corresponding interlocking portion located on a side of another adjacent wall element that abuts the respective side of each adjacent wall element.

11. A method according to claims 9, wherein the wall elements are placed in an arrangement where an inside face of each wall element forms a part of an inside surface of the wall.

12. A method according to claim 11, wherein the wall elements are placed in an arrangement where an outside face of each wall element forms a part of an outside surface of the wall.

13. A method according to claim 9, wherein the wall elements are placed in an arrangement where a curve in the body of each wall element contributes to a curve in the wall.

14. A method according to claim 11, wherein the wall elements are placed so that a concave curve of the inside face of each wall element contributes to form a constant concave curve in the inside surface of the wall.

15. A method according to claim 12, wherein the wall elements are placed so that a convex curve of the outside face of each wall element contributes to form a constant convex curve in the outside surface of the wall.

16. A method according to claim 9, wherein the wall elements are placed in consecutively connected rings of interlocking wall elements, each of the wall elements in each ring being of the same size.

17. A method according to claim 16, wherein the consecutively connected rings of interlocking wall elements are placed such that each successive ring is disposed of top of a respective preceding ring.

18. A method according to claim 9, wherein an adhesive is used to permanently couple the wall elements together.

19. A method according to claim 9, wherein the wall is sealed at joins between wall elements with a sealant.

20. A method according to claim 9, wherein each wall element is placed in position by a positioning arm pivotally attached at a lower end of the positioning arm to a center point of a supporting surface for the dome-shaped structure.

21. A method according to claim 9, wherein, during construction of the wall, each wall element is directed over an external surface of a partly constructed portion of the wall, with the partly constructed portion bearing some of the weight of the wall element as the respective wall element is moved into position to be connected to the partly constructed portion.

22. A wall element for use in constructing a wall of a building structure, the wall element including a connecting means for connecting the wall element to other wall elements to form the wall, wherein the wall element is of a hexagonal shape and includes first and second sides that are each of the same length, third and fourth opposing sides that are each of the same length and shorter than each of the first and second adjacent sides, and fifth and sixth adjacent sides that are each of the same length and shorter than each of the third and fourth opposing sides, wherein, in use, the wall element can be tessellated with a plurality of other wall elements to form a dome-shaped structure.

23. A wall element according to claim 22, wherein the connecting means of the wall element includes an interlocking portion located on each side of the wall element for connecting each side of the respective wall element to a corresponding side of another wall element.

24. A wall element according to claim 23, wherein each interlocking portion includes one of a projection and a complimentary recess that interlocks with the other of the projection and complimentary recess located on the corresponding side of another wall element.

25. A wall element according to claim 22, wherein the wall element includes a first face and second face opposite the first face, the first face of the wall element being of concave shape.

26. A wall element according to claim 25, wherein the second face of the wall element is convex in shape.

* * * * *